US006733555B1

(12) United States Patent
Wilder

(10) Patent No.: US 6,733,555 B1
(45) Date of Patent: May 11, 2004

(54) VACUUM BAG COLLAR

(75) Inventor: Brent A. Wilder, Bloomington, IL (US)

(73) Assignee: Wildwood Industries, Inc., Bloomington, IL (US)

( * ) Notice: Subject to any disclaimer, the term of this patent is extended or adjusted under 35 U.S.C. 154(b) by 0 days.

(21) Appl. No.: 10/090,043

(22) Filed: Feb. 27, 2002

Related U.S. Application Data

(60) Provisional application No. 60/272,264, filed on Feb. 28, 2001.

(51) Int. Cl.[7] ..... B01D 46/02

(52) U.S. Cl. ..... 55/367; 55/369; 55/DIG. 2; 55/DIG. 3; 15/347

(58) Field of Search ..... 55/367, 369, 374, 55/381, 370, 371, 373, 378, 496, 504, 505, 506, DIG. 2; 15/347

(56) References Cited

U.S. PATENT DOCUMENTS

| | | | |
|---|---|---|---|
| 1,007,390 | A | 10/1911 | Robinson |
| 2,758,667 | A | 8/1956 | Brace |
| 4,861,357 | A | 8/1989 | Gavin et al. |
| 4,877,432 | A | 10/1989 | Lackner |
| 5,064,455 | A | 11/1991 | Lackner |
| 5,092,915 | A | 3/1992 | Lackner |
| 5,158,635 | A | 10/1992 | Schmierer et al. |
| 5,468,271 | A | 11/1995 | Sauer et al. |
| 5,468,272 | A | 11/1995 | Schmierer |
| 5,472,460 | A | 12/1995 | Schmierer |
| 5,472,465 | A | 12/1995 | Schmierer |
| 5,725,619 | A | 3/1998 | Brule et al. |
| 5,725,620 | A | 3/1998 | Perea et al. |
| 5,820,643 | A | 10/1998 | Lienenluke et al. |

FOREIGN PATENT DOCUMENTS

| | | |
|---|---|---|
| DE | 2407478 | 8/1974 |
| DE | 3919256 | 12/1990 |
| DE | 4227617 | 2/1994 |
| GB | 27162 | 12/1908 |

*Primary Examiner*—Minh-Chau T. Pham
(74) *Attorney, Agent, or Firm*—Piper Rudnick LLP

(57) ABSTRACT

A user closable collar for a vacuum cleaner bag, the collar body being formed from a single blank of relatively rigid material which is folded to define three generally overlapping and planar panels, a middle panel having fixed raceway element which is adhesively secured to a first outer panel and a second outer panel, each of the outer panels having openings or apertures. A slider element is securely attached to the raceway element during the assembly process by retention bands of collar blank material and has containing an aperture thereon which is aligned with the apertures of the outer panels when in a closed position. The retention bands of collar material are cut through one of the outer panels, releasing the slider element such the slider element can be moved by a user from an open position to a closed position causing the apertures of said first and second outer panels to be occluded.

6 Claims, 3 Drawing Sheets

VACUUM BAG COLLAR

CLAIM OF PRIORITY

This application claims priority from U.S. Provisional Patent Application Ser. No. 60/272,264 filed Feb. 28, 2001.

BACKGROUND OF THE INVENTION

1. Field of Invention

This invention finds use in the field of collection bags, such as those used in vacuum cleaners and other debris collection devices and more particularly, this invention relates to a rigid collar which is attached to a vacuum cleaner collection bag which can be sealed by the user upon removal from the output nozzle of the vacuum cleaner.

2. Description of Prior Art Disposable vacuum bags for use in a vacuum cleaner are characteristically provided with collars for attachment to the vacuum outlet nozzle. Recently, some collar designs have included closures such that, when the vacuum bag is removed from the vacuum cleaner after use, the bag may be closed or sealed at the collar to retain therein the dirt and other particulate matter trapped in the bag. While great creativity, time and effort have been directed to the provision of a dependable automatically closable collar—that is, a collar which is reliably self-sealing immediately upon removal from the outlet nozzle pipe of a vacuum cleaner—many disposable vacuum bag users still prefer the certainty of a manually closable collar—that is, a collar which the user himself or herself seals after removal of the vacuum bag from the outlet nozzle.

Over time, a variety of manually closable collars have been designed and placed available on the market. Many designs require the presence of a portion enabling movement of a closure member from one location to another. It has been found that the provision of an easily flexible collar portion results in a complex and hence costly collar. This is particularly true with collars comprised of two or more separate pieces that are bonded to form a complete collar. While most basic vacuum bags may have only a one-ply die cut or a two-ply sandwiched collar, some of the manually closable constructions require additional ply layers, thus increasing the material cost and manufacturing expense of producing such bags. Finally, in the known three-ply collars of manually closable bags not requiring a flexible collar portion, higher production costs are involved. Once the collar has been appropriately folded, the fold between the closure member and another ply of the collar must be cut in order to free the closure member for movement relative to the remainder of the collar. This extra processing step entails additional manufacturing expense as well as the waste of a certain amount of the raw material since a fold between the closure member and another ply must be cut away and discarded.

One-piece, three-ply designs are well known in the art, such as U.S. Pat. Nos. 5,725,620 and 5,772,712 to Perea et al. However, such collars, while improvements over the previous art, still require numerous production punches and cuts to produce the finished piece.

It is therefore an object of the present invention to provide a manually closable collar for a vacuum cleaner bag, which collar is economical to and easy to manufacture, in that a minimal number of post assembly cuts and punches are made and material wasted.

It is another object of the present invention to provide a collar that is simple for the end user to operate.

It is an additional object of the present invention to provide a collar that adequately seals the filled vacuum cleaner bag such that a minimal amount of collected material is spilt or otherwise lost.

SUMMARY OF INVENTION

To attain the objects described above according to this invention, there is provided a collar for a vacuum cleaner bag having a user operated closure. The collar is formed from a blank of relatively rigid material and is folded to define first and second full outer panels, and a middle panel having a fixed raceway element which is adhesively secured to a first outer panel and a second outer panel, each of the outer panels having openings or apertures. A slider element is securely attached to the raceway element during the assembly process by retention bands of collar blank material and has containing an aperture thereon which is aligned with the apertures of the outer panels when in a closed position. The retention bands of collar material are cut through one or both of the outer panels, releasing the slider element such the slider element can be moved by a user from an open position to a closed position causing the apertures of said first and second outer panels to be occluded.

Other objects and advantages of the invention will become apparent from the following description of the invention wherein reference is specifically made to the drawings.

BRIEF DESCRIPTION OF THE DRAWINGS

Specific embodiments of the invention have been chosen for purposes of illustration and description, and are shown in the accompanying drawing, forming a part of the specification wherein.

DESCRIPTION OF PREFERRED EMBODIMENTS

Figure 1:
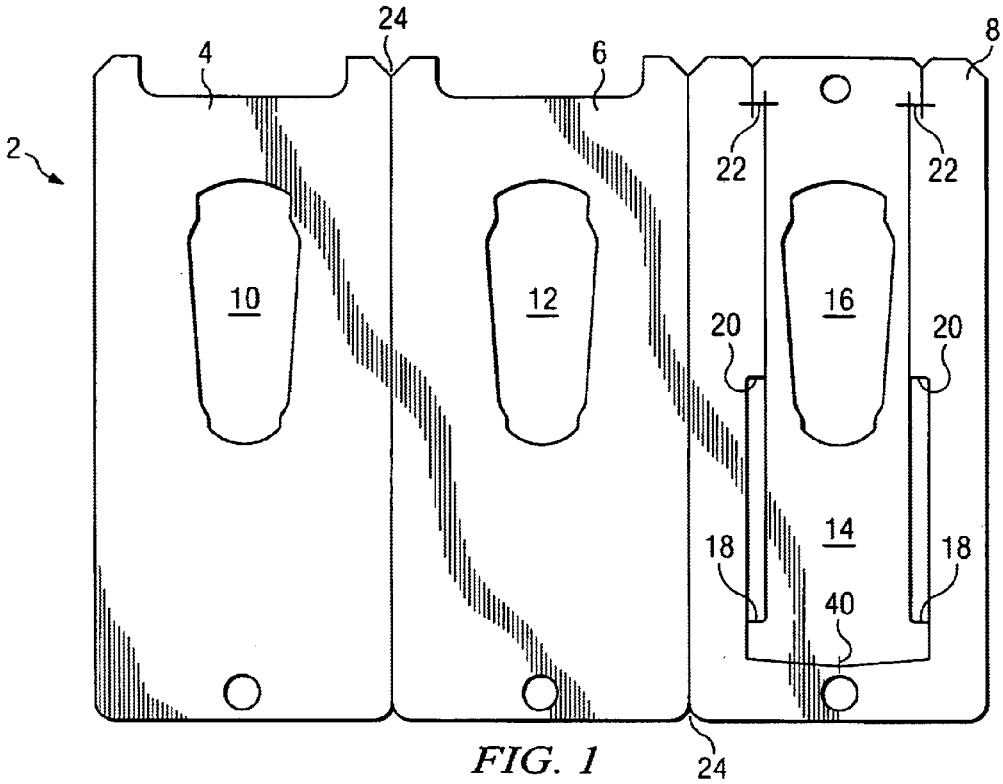
FIG. 1 is a front plan view of the vacuum bag collar of the present invention, prior to folding and assembly.

As shown in FIG. 1, the collar 2 is a one-piece design which is formed through conventional methods know in the art such as cutting or, preferably, machine punching. A relatively rigid material is used to form the collar preferably paperboard, although other materials used in the art are acceptable. The collar 2 thus formed is adapted to be secured to a vacuum bag (not shown) by means know to one skilled in the art, such as glue, in order to form a manually closable vacuum cleaner bag.

This collar 2 can generally be divided into back piece 4, front piece 6, and middle piece 8. Back piece 4 and front piece 6 further contain apertures 10 and 12, respectively. Apertures 10 and 12 are preferably of equal shape and diameter. Middle piece 8 contains slider element 14, which includes an aperture 16 and stepped portions 18, and shoulder portions 20. The middle piece 8 is cut during punching such that the slider element 14 is fully detached from the middle piece 8, except at retaining portions 22 in the preferred embodiment. In another embodiment of the invention, the slider element 14 can also be strongly attached or otherwise affixed to the middle piece 8 a t attachment point 40.

Figure 2:
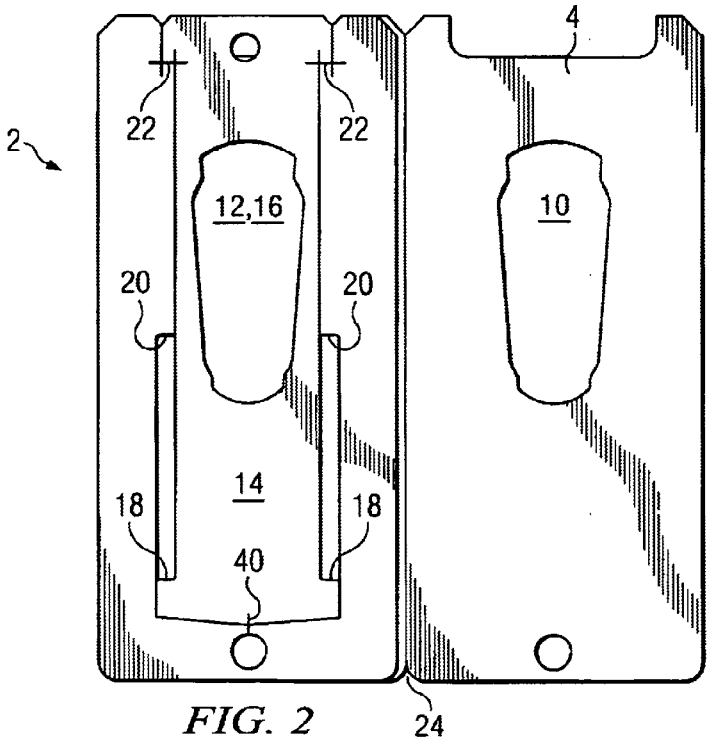
FIG. 2 is a rear plan view of the vacuum bag collar of the present invention, with the middle and front sections being folded together.

FIG. 2 shows the middle piece 8 an d front t piece 6 being folded together upon fold 24 such that t apertures 12 and 16 are in alignment. The front 6 and middle 8 pieces are then secured together through an adhesive applied to the backside of lateral edge s 26 of the middle piece (shown in FIG. 1).

Figure 3A:
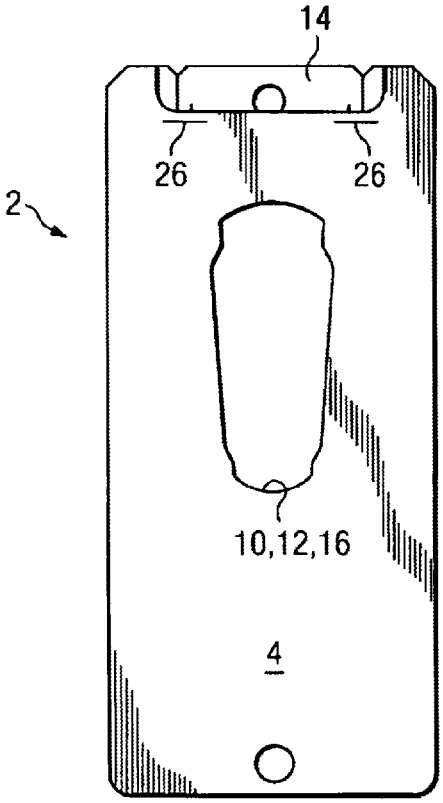
FIG. 3A is a front plan view of the vacuum bag collar of the present invention after final assembly.
Figure 3B:
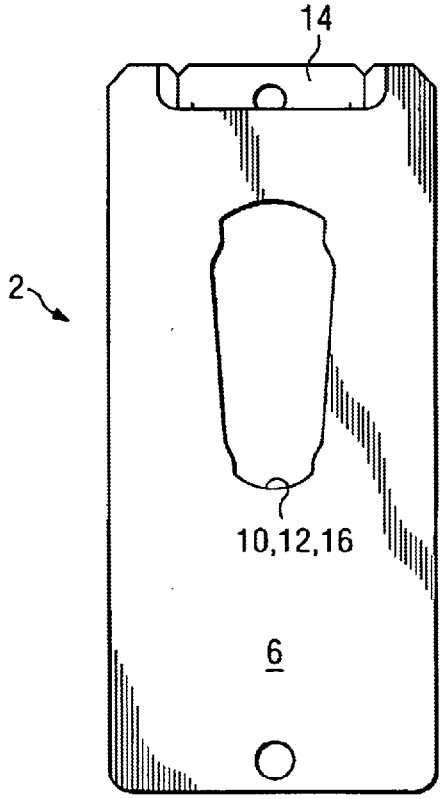
FIG. 3B is a rear plan view of the vacuum bag collar of the present invention after final assembly.

The completed collar 2 is shown in FIGS. 3A and 3B. The back piece 4 is folded over the middle e piece 8 upon folds 24 and is secured through an adhesive applied to the front side of lateral edges 26. The final step in the manufacturing process is to detach slider 14 from the middle piece 8 by severing retaining portions 22. This step is accomplished by creating cuts 26 through the back piece 4, retaining portions 22, and the front piece 6. Detachment of the slider can also be accomplished by creating cuts 26 through the front piece 6, retaining portions 22, and the back piece 4 or through either the front 4 or back 6 piece and the retaining portions 22 but not through the back 6 or front 4 piece, respectively. If slider element 14 is also attached to the middle piece 8 at point 40, as contemplated in the previously described alternative embodiment, a similar cut 26 through the front 4 and/or back 6 pieces and point 40 should be made.

Figure 4:
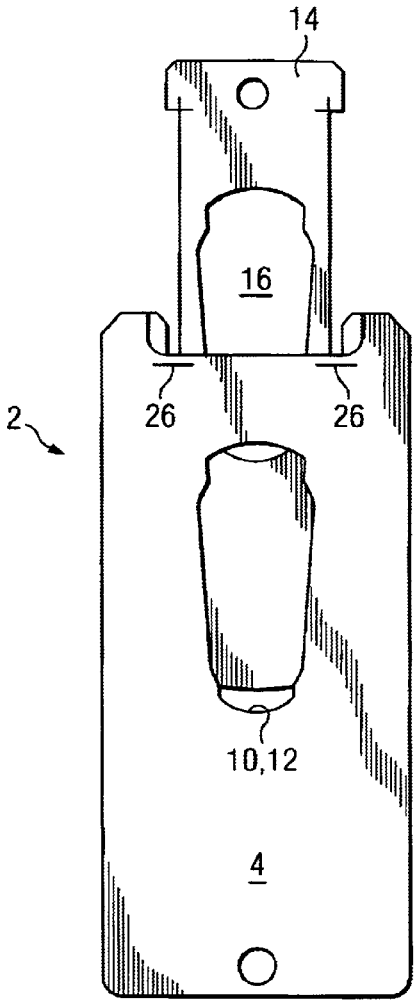
FIG. 4 is a front plan view of the vacuum bag collar of the present invention after final assembly with the slider element detached and extended.

As shown in FIG. 4, the slider element 14 is then able to be moved upward by the end-user such that the aperture (10, 12) is mostly occluded the unapertured portion of the slider element. The slider element 14 is "overlapped" by, and thus retained, between the front 4 and back pieces 6 and cannot be removed due to interference between the steps 18 of the slider and the shoulders 20 of the middle piece 8. One will note that when the slider 14 is fully extended, aperture 16 is no longer in registry with aperture 10, 12.

Figure 5:
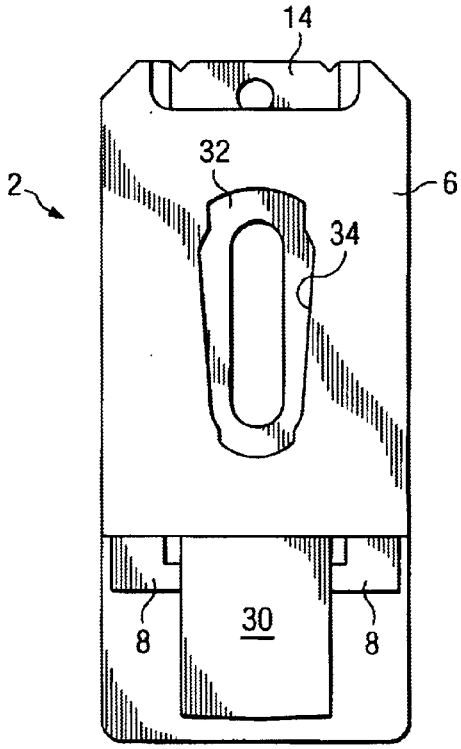
FIG. 5 is a rear plan view of an alternative embodiment of the vacuum bag collar of the present invention.

FIG. 5 illustrates alternative embodiments of the collar 2 of the instant invention which may be implemented jointly or separately. In a first alternative embodiment, a barrier 32 formed from a piece of paper other thin, flexible material is attached to the bottom of the slider 14 with an adhesive. When the slider 14 is withdrawn by the end user, as shown in FIG. 4, the entirety of aperture 10, 12 is occluded by the slider 14 and the barrier 30. In a second embodiment a resilient membrane or gasket 32 of rubber or similar substance having an alignable aperture 34 can be added and adhered to either the front 4 or back 6 piece during the assembly process such that the resulting aperture formed is somewhat smaller than the normal aperture 10, 12, 16 in the closed position, thus allowing a tighter fit to the vacuum cleaner outlet nozzle (not shown). Finally, it is contemplated that back piece 6 and middle piece 8 can be reduced in size, as compared to the front piece 4, to save on material costs. The only restraint on size is the requirement that the slider element 14 is "overlapped" by, and thus retained, between the front 4 and back pieces 6 and cannot be removed due to interference between the steps 18 of the slider and the shoulders 20 of the middle piece 8.

In addition to the structures, sequences, and uses immediately described above, it will be apparent to those skilled in the art that other modifications and variations can be made the method of the instant invention without diverging from the scope, spirit, or teaching of the invention. Therefore, it is the intention of the inventors that the description of instant invention should be considered illustrative and the invention is to be limited only as specified in the claims and equivalents thereto.

What is claimed is:

1. A user closable collar for a vacuum cleaner bag, comprising:

a collar body formed from a single blank of relatively rigid material which is folded to define three generally overlapping and planar panels, said collar body further comprising:

a middle panel having a fixed raceway element which is adhesively secured to a first outer panel and a second outer panel;

a slider element securely and non-detachably attached to said raceway element during the assembly process by retention bands of collar blank material, said slider element further containing an aperture therein;

an apertured portion on said first outer panel and an apertured portion on said second outer panel, wherein said aperture of the slider element is aligned with the apertures of the first outer panel and the second outer panel; and means for severing said retention bands and separating said slider element from said middle panel, whereby the slider element can be moved by a user from an open position to a closed position causing the apertures of said first and second outer panels to be occluded.

2. The collar of claim 1 further comprising a resilient membrane intermediate to said middle panel and one of said first or second outer panels and defining an aperture therethrough aligned with said apertures of said outer panels.

3. The collar of claim 1 wherein the slider element further comprises a top portion and a bottom portion and a thin flexible barrier affixed to said bottom portion, whereby the apertures of the first and second outer panels are fully occluded when the slider element is in a full open position.

4. A method of making a user closable collar for a vacuum cleaner bag, comprising the steps of:

(a) folding a single blank of relatively rigid material to define three overlapping and generally planar panels, said panels defined by a first outer panel, a second outer panel, each having an aperture therein, and an inner panel having a top and bottom portions, and a middle panel having a fixed raceway element and a slider element securely attached to said raceway element during the assembly process by retention bands of collar blank material, said slider element having top and bottom portions and further containing an aperture therein;

(b) adhesively securing the top and bottom portions of said middle panel to said first and second outer panels;

(c) cutting through one of said outer panels and said retention bands of collar material, whereby said slider element is freed from said middle panel and in a closed position the aperture of the slider element and the apertures of the outer panels are in alignment and said apertures of the first and second outer panels are occluded by said slider when the user operates the slider element to an open position.

5. The method of claim 4 comprising the additional step of interposing a resilient membrane intermediate between one of said outer panels and said middle panel, the resilient membrane defining aperture aligned with the apertures of said outer panels.

6. The method of claim 4 comprising the additional step of affixing a thin flexible barrier to the bottom portion of the slider element whereby the apertures of the first and second outer panels are fully occluded when the slider element is in a full open position.

* * * * *